United States Patent [19]

Grindstaff et al.

[11] Patent Number: 5,069,845

[45] **Date of Patent: * Dec. 3, 1991**

[54] IMPROVEMENTS IN PROCESS FOR PREPARING SPIN-ORIENTED FEED YARNS

[75] Inventors: Teddy H. Grindstaff; Cecil E. Reese, both of Kinston, N.C.

[73] Assignee: E. I. Du Pont de Nemours and Company, Wilmington, Del.

[ * ] Notice: The portion of the term of this patent subsequent to Dec. 3, 2008 has been disclaimed.

[21] Appl. No.: 420,458

[22] Filed: Oct. 12, 1989

Related U.S. Application Data

[63] Continuation-in-part of Ser. No. 228,799, Jul. 28, 1988, abandoned, which is a continuation-in-part of Ser. No. 934,221, Nov. 21, 1986, abandoned.

[51] Int. Cl.[5] ..... D01F 6/62; D01F 11/04

[52] U.S. Cl. ..... 264/103; 264/129; 264/130; 264/134; 264/136; 264/210.3; 264/210.8; 264/211.15

[58] Field of Search ..... 264/211.14, 129, 103, 264/130, 134, 136, 210.3, 210.8, 211.15

[56] References Cited

U.S. PATENT DOCUMENTS

| | | | |
|---|---|---|---|
| 3,110,617 | 11/1963 | Scott | 427/175 |
| 4,316,924 | 2/1982 | Minemura et al. | 428/89 |
| 4,396,389 | 8/1983 | Löfgren | 8/115.5 |

FOREIGN PATENT DOCUMENTS

| | | |
|---|---|---|
| 3324662 | 7/1982 | Fed. Rep. of Germany . |
| 1189299 | 10/1959 | France . |
| 47-35608 | 9/1972 | Japan . |
| 49-1257 | 1/1974 | Japan . |
| 55-4845 | 2/1980 | Japan . |
| 56-31073 | 3/1981 | Japan . |
| 56-140167 | 11/1981 | Japan . |
| 58-169512 | 12/1983 | Japan . |
| 58-180672 | 1/1984 | Japan . |
| 61-231218 | 3/1987 | Japan . |
| 839456 | 6/1960 | United Kingdom . |
| 1093628 | 12/1967 | United Kingdom . |
| 850169 | 9/1968 | United Kingdom . |
| 1276329 | 6/1972 | United Kingdom . |

OTHER PUBLICATIONS

Hermann Ludewig, Polyester Fibres—Chemistry and Technology, 1964, Engl Trans 1971, John Wiley & Sons, Ltd., 387-389.

*Primary Examiner*—Hubert C. Lorin

[57] ABSTRACT

Polyester filaments in spin-oriented feed yarns, such as DTFY, and in draw-textured and other drawn yarns therefrom, and in fabrics and garments of such yarns, are prepared by an improved process involving treatment of the freshly-extruded polyester filaments with caustic in the spin-finish, so as to improve moisture-wicking properties.

3 Claims, No Drawings

IMPROVEMENTS IN PROCESS FOR PREPARING SPIN-ORIENTED FEED YARNS

CROSS-REFERENCE TO RELATED APPLICATIONS

This application is a continuation-in-part of copending application Ser. No. 07/228,799, filed July 28, 1988, now abandoned which itself is a continuation of application Ser. No. 6/934,221, filed Nov. 21, 1986, now abandoned.

TECHNICAL FIELD

This invention concerns improvements in and relating to draw-texturing (and other spin-oriented continuous filament) feed yarns of the polyester type, and more particularly to such yarns whose filaments are modified to provide entirely new properties, especially in the resulting improved textiles, e.g. resulting textured yarns, and including textile articles such as fabrics and garments containing such textured yarns, and to a process for draw-texturing such feed yarns to provide the improved textured yarns.

BACKGROUND OF THE INVENTION

Synthetic polyester yarns have been known and used commercially for several decades, having been first suggested by W. H. Carothers, U.S. Pat. No. 2,071,251, and then by Whinfield and Dickson, U.S. Pat. No. 2,465,319. In particular, polyester draw-texturing feed yarn (DTFY) has been an industrial commodity that has been manufactured and used on a very large scale, having been first disclosed, with the process of its draw-texturing into textured yarns, by Petrille in U.S. Pat. No. 3,771,307, and by Piazza and Reese in U.S. Pat. No. 3,772,872. The resulting textured yarns have been made into textile fabrics, and eventually into garments and other textiles. Interest has also developed in spin-oriented polyester filaments for other purposes, such as draw-warping to make textile yarns. Polyester multifilament textile yarn has been recognized as having significant advantages over cotton yarns in some respects, for instance its thermoplastic characteristics that enable polyester-containing fabrics to hold their shape, for instance a crease, and to have wash-wear characteristics, its low cost of manufacture, its uniformity, its superior strength, and its resistance to degradation. However, hitherto, some have expressed a preference for wearing garments from cotton fibers because of attributes that can be summarized as "comfort", to the extent that there has been a trend recently towards using more 100% cotton fabrics, despite the practical advantages of wash-wear 100% polyester fabrics. Because of the sophistication of the textile industry, both of the polyester fiber manufacturing industry and of downstream consumers of textiles, and because of the commercial interest in providing apparel and fabrics that will perform well during actual use by the ultimate consumer (wearer), much attention has been devoted to analyzing appropriate requirements. Many technical papers, for example, have been published on various aspects, and patents have been issued with the objective of improving the "comfort" that can be obtained from textile articles, and their constituents, and the literature has been replete with these suggestions for several years. So it has long been considered desirable to improve various properties of textiles prepared from multi-filament polyester yarns, and much effort has been devoted in the textile industry towards this objective.

An important objective of our invention is to provide such polyester draw-texturing feed yarns (DTFY) and other spin-oriented feed yarns in a new form such that they can be processed, e.g. draw-textured, into textile yarns, e.g. textured yarns, which can then be formed into fabrics and garments that can show improved moisture-wicking properties, as discussed herein.

Polyester filaments are characterized by their extreme hydrophobic character, as mentioned in "Polyester Fibres—Chemistry and Technology", by H. Ludewig—English translation 1971—John Wiley and Sons, Ltd., in Section 11.1.5 on pages 377–378, and also in Section 11.4 on dyeing properties, starting on page 398. Indeed, the difficulty of dyeing polyester yarns and fabrics is notorious. Ludewig's book mentions many aspects of polyester fibers and their preparation and properties.

Polyester DTFY has been manufactured by melt-spinning (i.e. extruding molten polyester polymer) to form a bundle of amorphous spin-oriented filaments that are withdrawn at high speeds, generally of the order of 3–4 km/min., as disclosed by Petrille, Piazza and Reese, and others, with interlacing to provide a coherent yarn. DTFY is stable to storage and heat, so that it can be stored and strung-up (like drawn polyester yarn) on a draw-texturing machine with a heater at a desirably elevated temperature, e.g. of the order of 200° C. or more. In this respect, spin-oriented feed yarns are entirely different from amorphous yarns that used to be prepared at lower speeds (such as 1 km/min.) which stick to such heaters, and lose strength and break.

It is conventional to coat all freshly-extruded filaments with a "finish", which is generally an aqueous emulsion comprising a lubricant and an antistat. Finishes are discussed briefly in Section 5.5, starting on page 193, of Ludewig, referred to above. As mentioned on page 195, the literature reveals relatively little about the compositions of the spin-finishes that are actually used. Although there is now considerable patent and other literature, the precise finish formulations are generally closely-guarded secrets by the yarn manufacturers, and different compositions are formulated for different purposes, depending on the particular intended processing and possible specific requests by individual customers, and these formulations change, sometimes quite frequently. As will be related hereinafter, a dramatic change in the surface properties of the filaments of the eventual textured yarns, and of articles containing them, such as fabrics and garments, may be obtained by a relatively simple modification to the spin-finish that is applied to the freshly-extruded polyester amorphous spin-oriented filaments. Conventionally, the spin-finish is the first contact that a freshly-extruded filament encounters after solidification. The finish was generally applied by a finish roll, rotating in a bath of the finish, so that the filaments pass through the finish emulsion as they brush past the finish roll on their way from the solidification zone to the feed roll that determines the withdrawal speed from the spinneret. Before the finish roll, it is generally desirable to avoid or minimize contact between the filaments and solid objects, and so the only other closely-adjoining solid objects are generally guides that are intended to confine the filaments before contacting the finish roll. A finish roll is not the only method of applying finish, and other methods have been used and suggested, including spraying or metering the finish onto the filaments.

SUMMARY OF THE INVENTION

According to the present invention, the moisture-wicking properties of draw-textured and such like polyester filaments and yarns in textile fabrics and garments can be significantly changed by adding a small amount of caustic to the spin-finish, i.e. very early in the yarn-making process, so that the caustic can modify the surface of the spin-oriented filaments as they are freshly extruded. This change has caused the polyester surface to be modified and have improved moisture-wicking properties, after washing. It is surprising that this long-desired improvement can be achieved by such a small change in the conventional process, and that this has not been reported hitherto, so far as we know, despite the many references in the literature to treatments, especially of fabric, with caustic soda among other materials.

Accordingly, there is provided an improvement in a process for preparing a stable amorphous spin-oriented draw-texturing or other feed yarn, comprising the steps of melt-spinning polyester into filaments that are withdrawn at a high speed, treating the freshly-extruded filaments with a spin-finish and collecting them in the form of a bundle, and further processing such bundle as a multi-filament feed yarn, with interlacing to improve bundle coherency, the improvement characterized by treating the freshly-extruded filaments with a small amount of caustic, in sufficient amount and sufficiently rapidly so as to modify the surface of the polyester, so the resulting feed yarns, and the eventual textile yarns, are new and improved in that the polyester filaments have a modified surface that has improved moisture-wicking properties, when washed, so as to provide improved comfort to the new downstream articles, such as fabrics and garments that incorporate such textured yarns and filaments.

DETAILED DESCRIPTION OF THE INVENTION

For convenience, despite the fact that the surface has been changed, so that the moisture-wicking characteristics are not what has hitherto been associated with "polyester" filaments and yarns, we shall refer to both treated and untreated materials by the term "polyester", for reasons which will be apparent.

At this point, we refer to application Ser. No. 06/934,220 as well as to copending application Ser. No. 420,457 (filed simultaneously herewith), because of the description of corresponding surface-modification of polyester filaments during the preparation of filamentary tows, staple fiber and spun yarn therefrom, and because development of that technology has proceeded further, and so the disclosure therein is incorporated by reference, because it is believed that essentially similar technical findings will apply to the present invention and textile materials herein, and because several comments and in particular tests and comparisons, and some aspects of thresholds and amounts, related therein, could apply to the polyester filaments treated according to the present invention, with, however, also a caution that, since an essential element of the invention concerns working with freshly-extruded filaments and a rate phenomenon, as disclosed therein, in other words since this is a frehly-exposed surface phenomenon, if the dimensions and quantities of the treated filaments are changed significantly, adjustments have had to be made to the quantities of caustic to achieve the same desired effect, as can be seen by a comparison of the working Examples in the various cases. Indeed, much of our knowledge herein has still been based on speculation, and it is possible that the subsequent draw-texturing process may be of importance, the exact nature of which has not yet been recognized.

The preparation of the spin-oriented polyester feed yarn, such as DTFY, may be carried out conventionally except for the application of caustic to the freshly-extruded filaments, and then the treated filaments may be processed conventionally, including draw-texturing to form textured yarns, and eventually making fabrics, e.g. by knitting or weaving, and garments by conventional techniques. Generally, hitherto, spin-oriented polyester filaments have been prepared by melt-spinning, and the undrawn filaments have been treated with a spin-finish, collected into a bundle, interlaced, and wound up at high speeds of the order of 3–4 km/min. According to the invention, this conventional process is modified by treating the freshly-extruded filaments with caustic, such as caustic soda or caustic potash. As indicated, this may most conveniently be effected by adding an appropriate amount of caustic to the finish that is applied to the freshly-extruded filaments, since the application of finish is essentially the first treatment or contact that the freshly-extruded filaments encounter after solidification. It is important, according to the invention, that this treatment with caustic be effected on these freshly-extruded filaments, which are often referred to as "live" filaments, since the effect appears to be different from that obtained if caustic soda is applied at a later stage to fabrics, according to prior art teaching. If the application of a small amount of caustic is not sufficiently prompt, the caustic will not improve the moisture-wicking properties significantly, as discussed in the copending application referred to.

We believe that there has been a chemical change to the surface of the filament, from its regular hydrophobic nature, that has been a characteristic of polyester as reported, e.g. by Ludewig. The core appears to be relatively unchanged from regular polyester polymer, whereas the surface has been significantly changed so that the yarn, fabric and garments show improved moisture-wicking properties, after washing. Since the treatment is applied to the surface of the freshly-extruded filament, which is undrawn, and this filament is then subjected to a drawing process, in which the surface of the filament is significantly increased, which must mean that new surface is created from polymer that had previously been concealed beneath the surface of the undrawn filament, it is extremely surprising that the improvement in properties are shown in the fabrics and garments, that contain drawn material, whereas it was the undrawn filament that was treated with caustic. In order to obtain the improved properties, the filament surfaces must be washed, as described in the above-mentioned copending application. This usually occurs during normal processing, e.g. of the fabrics, but may apply at any stage of processing of the textured yarns, or of the feed yarn (DTFY).

Precautions need to be taken and modifications must probably be made to avoid or minimize corrosion or other contamination and other disadvantages that may result because of the use of caustic according to the invention. For such reasons, hitherto, it has been considered highly undesirable to include any dangerous or corrosive material, such as caustic, even in the small amounts indicated, at this stage of the process. This is at least one reason why, so far as we know, hitherto, there has previously been a prejudice against the use of a material such as caustic at this stage of a process for preparing polyester DTFY. In this regard, it should be recognized that the filaments travel at such high speeds that it is difficult to avoid 'slinging', i.e., release of droplets of finish from these high speed filaments after application of the finish.

The invention is further illustrated in the following Example; all parts and percentages are by weight.

EXAMPLE

A. Regular polyester DTFY (254/34) was spun from poly(ethylene terephthalate) homopolymer of about 21 LRV, containing 0.3% by weight of $TiO_2$, at a polymer temperature of 292° C. through capillaries of 15×60 mils (diameter ×length) and of round cross-section at 3200 mpm, being quenched by cross-flow air, using a standard 3 roll wind-up with interlacing, to give the properties shown in the Table. Standard commercial finish was applied, and the yarn A picked up 0.35% by weight FOY (Finish on Yarn).

B. The same procedure was followed, except that sufficient caustic potash (KOH), was added to the standard finish to raise the pH of this finish to 12. The finish pick-up was 0.3% FOY, and the filaments contained 0.003% by weight of KOH on their surface. As can be seen from the Table, the properties of surface-modified DTFY B are essentially similar to those of regular polyester DTFY A.

Both yarns were draw-textured using an experimental Barmag M-80 12 position machine at a speed of 850 mpm. A Barmag T-6 arrangement of a 0-9-0 disc stack using Kyocera ceramic discs was used. The first and second heaters were set at 220° C. and 190° C., respectively. The draw ratios required were both found to be 1.70×and were used. The D/Y ratio was 2.25. Overfeed was adjusted to give excellent packages. The textured yarns were found to have properties which are also shown in the Table and are comparable.

The textured yarns were knit into tubing using a Lawson-Hemphill FAK circular knitter. The tubing was scoured to remove finish applied in spinning and all oils used in texturing and knitting. Part of the fabric was dyed using procedures accepted in the trade. Scoured fabric, either undyed or dyed, was carefully rinsed with water to insure that all foreign materials such as oils, soaps and carriers were removed. The fabric was then allowed to dry thoroughly.

A. When a drop of water was applied to fabric A (the control), it spread very slowly, if at all. After as long a period as five minutes, nearly all of the water dropped on the fabric had stayed as a droplet, so that it was easily removed using the eye dropper which was used to put the water on the fabric surface. This behavior is typical of conventional polyester fabrics, because of the extremely hydrophobic nature of conventional polyester filaments.

B. When a drop of water was applied to fabric B, according to the invention, it spread very rapidly, within about a second, over a rather wide section of the fabric surface. Thus fabric B had excellent wickability, demonstrating entirely different and improved surface properties in contrast to conventional polyester A. This behavior is comparable more with that of cotton than of conventional polyester as pointed out in the above-mentioned copending application, and proved durable.

TABLE

| | A | B |
|---|---|---|
| Properties of DTFY | | |
| Denier | 254 | 255 |
| Modulus (gpd) | 24 | 24 |
| Tenacity (gpd) | 2.38 | 2.41 |
| Elongation (%) | 125 | 130 |
| Boil-Off Shrinkage (%) | 65 | 66 |
| Birefringence | 0.040 | 0.040 |
| Density | 1.3429 | 1.3428 |
| (Crystallinity Index %) | 6.6 | 6.6 |
| Texturing Conditions | | |
| Speed (mpm) | 850 | 850 |
| Draw Ratio | 1.70 | 1.70 |
| Pre-disc Tension (g) | 62 | 63 |
| Post-disc Tension (g) | 80 | 83 |
| Textured Yarn Properties | | |
| Denier | 161 | 161 |
| Modulus (gpd) | 40 | 43 |
| Tenacity (gpd) | 4.1 | 4.2 |
| Elongation (%) | 23 | 25 |
| TYT | 22 | 20 |

It is to be expected that other materials can be used to give a similar effect. For instance, in the above-mentioned copending application caustic soda (NaOH) has been used to improve the moisture-wicking performance of polyester for use in spun yarns, and fabrics thereof, so it is to be expected that other alkali metal hydroxides, alkaline earth metal hydroxides or equivalent basic materials may give an essentially equivalent effect.

As mentioned in the above-mentioned copending application, fabrics and garments from the spun yarns in the Example therein are expected to provide soft, dry, cool and airy aesthetics, and more breathability, and that the hydrophilic surface-modified polyester is expected to give even more of the advantages where improved moisture-wicking is important, such as coolness and dryness, (as compared with prior art polyester that has not been surface-modified). Similarly, fabrics and garments from textured yarns or filaments according to the present invention are expected to show advantages where moisture-wicking is important. Such articles will generally contain at least about 10% by weight, preferably 75% or more of the textured yarn or filaments, and especially those consisting essentially entirely of the textured yarn or filaments according to the invention. The filaments may be of conventional deniers and other characteristics for making textured yarns and fabrics and garments therefrom, using conventional techniques. The filaments may be round or of any other cross-sections, such as scalloped-oval, or trilobal, if desired.

Although conventional polyester, i.e. poly(ethylene terephthalate) is used in the Example herein, as mentioned in the copending application, other polyesters, such as copolymers, e.g. with cationic or other dye-modifiers, may be used, and changes may be made accordingly to correspond with such changes to the polymer, e.g. in the methods of preparation and testing. The advantage of the invention is that the normal hydrophobic surface is significantly changed by the simple treatment of freshly-extruded filaments with caustic according to the invention, and the invention is not considered restricted by the nature of the polyester polymer, nor by the cross-section or configuration of the filaments. Indeed, we believe that certain copolymers and special configurations may respond somewhat more easily to surface-modification than those in the Example.

We claim:

1. An improvement in a process for preparing a stable amorphous spin-oriented draw-texturing or other feed yarn, comprising the steps of melt-spinning polyester into filaments that are quenched as they are withdrawn from the spinneret at a high speed termed the withdrawal speed, treating the freshly-extruded filaments with a spin-finish and collecting them in the form of a bundle, and further processing such bundle as a multifilament feed yarn, with interlacing to improve bundle coherency, the improvement characterized by treating the freshly-extruded filaments with a spin-finish containing an amount of caustic selected and at a location selected such that, in combination with the withdrawal speed and quenching conditions, the caustic treatment is sufficiently soon so as to modify the surface of the polyester, so as to improve the moisture-wicking properties, when washed, as indicated by the polyester having at least 0.2 surface carboxyl equivalents per million grams of drawn fiber.

2. A process according to claim 1, wherein the freshly-extruded polyester filaments are treated so that the polyester has at least 0.3 surface carboxyl equivalents per million grams of drawn fiber.

3. An improvement in a process for preparing a textured yarn, comprising the steps of preparing a stable amorphous spin-oriented draw-texturing feed yarn, and subjecting the feed yarn to draw-texturing, the improvement characterized in that the feed yarn is prepared by a process according to claim 1 or 2, whereby the surface of the polyester of the textured yarn is modified so as to improve the moisture-wicking properties, after washing.

* * * * *